US007920804B2

(12) United States Patent
Mori et al.

(10) Patent No.: US 7,920,804 B2
(45) Date of Patent: Apr. 5, 2011

(54) DEVELOPING DEVICE AND IMAGE FORMING APPARATUS HAVING THE SAME

(75) Inventors: Yukihiro Mori, Osaka (JP); Mitsuhiro Hashimoto, Osaka (JP)

(73) Assignee: Kyocera Mita Corporation (JP)

( * ) Notice: Subject to any disclaimer, the term of this patent is extended or adjusted under 35 U.S.C. 154(b) by 27 days.

(21) Appl. No.: 12/426,412

(22) Filed: Apr. 20, 2009

(65) Prior Publication Data

US 2009/0269098 A1 Oct. 29, 2009

(30) Foreign Application Priority Data

Apr. 23, 2008 (JP) ..... 2008-112891

(51) Int. Cl.
*G03G 15/08* (2006.01)
*G03G 21/20* (2006.01)

(52) U.S. Cl. ..... 399/94; 399/252

(58) Field of Classification Search ..... 399/94, 399/252, 254, 267, 274, 284
See application file for complete search history.

(56) References Cited

U.S. PATENT DOCUMENTS

2002/0191982 A1* 12/2002 Tsukamoto et al. ..... 399/94
2004/0114971 A1 6/2004 Sakai et al.

FOREIGN PATENT DOCUMENTS

JP 05-188754 A * 7/1993
JP 11-174795 A * 7/1999
JP 11-272076 A * 10/1999
JP 2000-112227 A * 4/2000
JP 2000-305344 A * 11/2000
JP 2004-029103 A * 1/2004
JP 2004-109868 4/2004
JP 2005-062683 A * 3/2005
JP 2007-057593 A * 3/2007
JP 2007-094013 A * 4/2007
JP 2007-264030 A * 10/2007
JP 2007-279279 A * 10/2007
JP 2008-070402 A * 3/2008
JP 2008-180854 A * 8/2008
JP 2008-299229 A * 12/2008
JP 2009-036852 A * 2/2009
JP 2009-058695 A * 3/2009

* cited by examiner

*Primary Examiner* — Sophia S Chen
(74) *Attorney, Agent, or Firm* — Gerald E. Hespos; Michael J. Porco

(57) ABSTRACT

A developing device according to the present invention includes a developer storing section storing a developer, a stirring member disposed in the developer storing section and transporting the developer while stirring the developer, a developer carrier receiving the developer from the developer storing section and carrying the developer, a developer regulating member regulating the amount of the developer received by the developer carrier from the developer storing section, and a heat-dissipating member disposed at a position in contact with the developer and capable of dissipating heat of the developer. The heat-dissipating member has a surface in contact with the developer and the contact surface of the heat-dissipating member has an arithmetic surface roughness Ra1 that is set to be equal to or less than ⅓ of the volume average particle size of toner particles contained in the developer.

8 Claims, 5 Drawing Sheets

DEVELOPING DEVICE AND IMAGE FORMING APPARATUS HAVING THE SAME

BACKGROUND OF THE INVENTION

1. Field of the Invention

The present invention relates to a developing device that stores and supplies toner for forming a toner image, and to an image forming apparatus having the developing device.

2. Description of the Related Art

A developing device generally includes a developer storing section that holds a toner-containing developer and that transports the developer while stirring the latter, a developing roller that receives the toner from the developer storing section and carries the toner, and a developer regulating blade that regulates the amount of toner supplied to the developing roller. In the developing device having the above configuration, the friction heat generated due to developer stirring causes the temperature in the developing device to rise. This may induce toner melting in the developing device, which makes it difficult to achieve a toner image of good quality.

Techniques for suppressing temperature rises in developing devices are disclosed in, for example, Japanese Laid-open Patent Application No. 2004-109868. The developing device in Japanese Laid-open Patent Application No. 2004-109868 includes a ventilation duct disposed in the vicinity of a developer regulating blade. This configuration makes it possible that friction heat is dissipated by way of the developer regulating blade, which is in contact with the developer, to suppress temperature rises inside the developing device.

In the developing device, however, the developer adheres readily onto the surface of the developer regulating blade. This surface-covering developer may decrease the thermal conductivity of the developer regulating blade. The above-described suppressing effect on temperature rise is decreased, and hence it is difficult to realize toner images of good quality even when using the ventilation duct.

In the quest to improve image reproducibility, there is recently a growing demand for using smaller particle sizes in carriers and toner, which are the components of developers. The smaller particle size, however, makes the developer less fluid, and hence become easily heated. This underscores the need for further suppressing temperature rises inside the developing device.

SUMMARY OF THE INVENTION

In the light of the above, it is an object of the present invention to provide a developing device that can suppress temperature rises caused by friction heat resulting from, for example, developer stirring, and to provide an image forming apparatus having such a developing device.

To achieve the above object, the developing device according to the present invention includes a developer storing section storing a developer, a stirring member disposed in the developer storing section and transporting the developer while stirring the developer, a developer carrier receiving the developer from the developer storing section and carrying the developer, a developer regulating member regulating the amount of the developer received by the developer carrier from the developer storing section, and a heat-dissipating member disposed at a position in contact with the developer and capable of dissipating heat of the developer. The heat-dissipating member has a surface in contact with the developer and the contact surface of the heat-dissipating member has an arithmetic surface roughness Ra1 that is set to be equal to or less than ⅓ of the volume average particle size of toner particles contained in the developer.

These and other objects, features and advantages of the present invention will become more apparent upon reading of the following detailed description along with the accompanied drawings.

DETAILED DESCRIPTION OF THE PREFERRED EMBODIMENTS

Preferred embodiments for carrying out the invention will be explained in detail next with reference to accompanying drawings.

Figure 1:
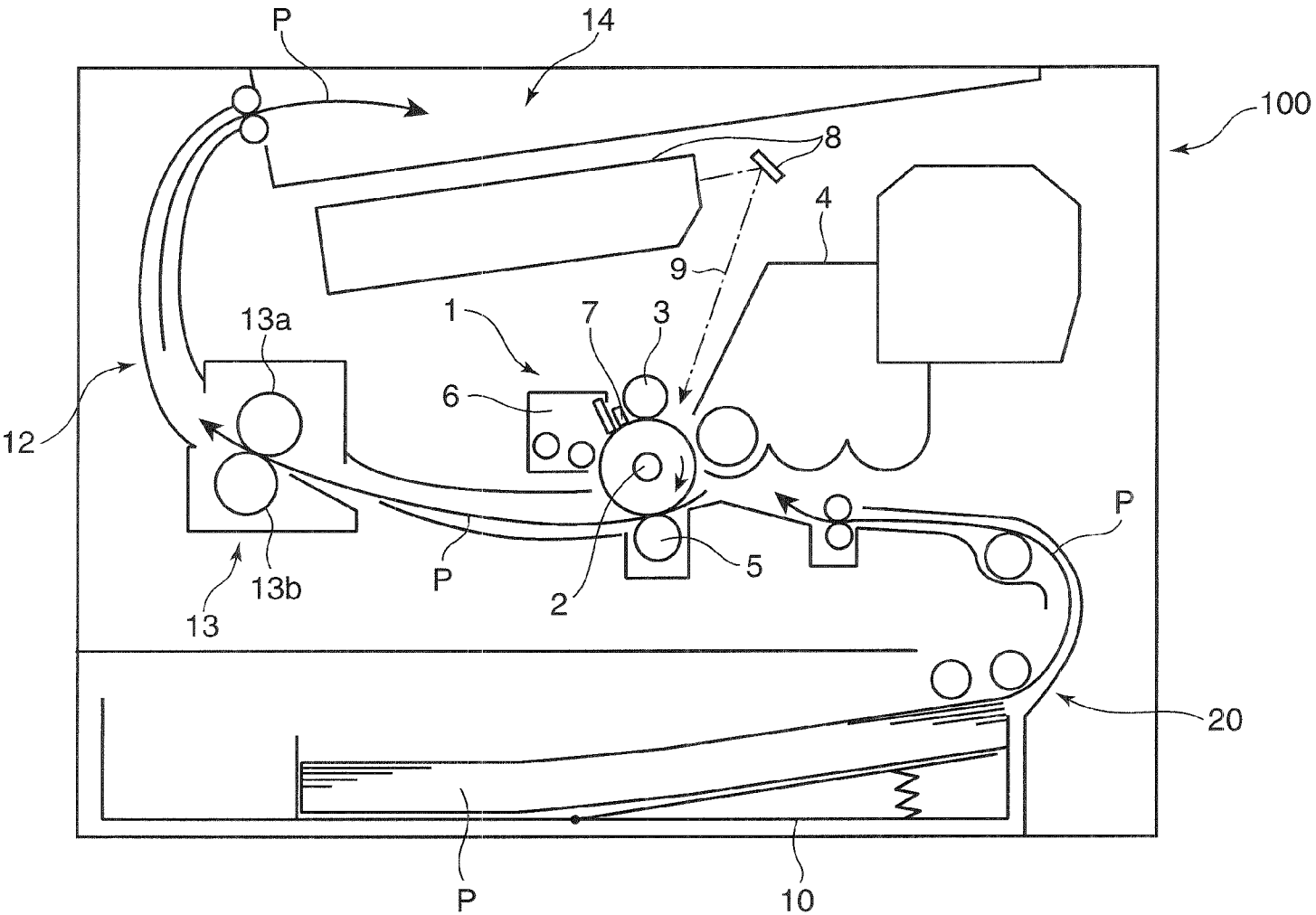
FIG. 1 is a front view illustrating schematically the configuration of an image forming apparatus having a developing device according to the present invention.

FIG. 1 is a front cross-sectional view illustrating schematically the construction of an image forming apparatus provided with a developing device according to the present embodiment. An image forming apparatus 100, for instance a printer, includes an image forming unit 1 that forms a toner image on a recording medium such as paper P, on the basis of image data transmitted from an external device such as a computer, a fixing unit 13 that carries out a fixing process to the toner image on the paper P, a paper storage unit 10 that stores the papers P, and a paper discharge unit 14 that discharges the paper P after fixing.

The image forming unit 1 includes a photosensitive drum 2 having a peripheral surface on which an electrostatic latent image is formed and then a toner image is formed over the electrostatic latent image, a charger 3 that charges uniformly the peripheral surface of the photosensitive drum 2, a developing device 4 that supplies toner to the electrostatic latent image on the peripheral surface of the photosensitive drum 2, a transfer roller 5 that transfers the toner image to paper P passing through a nip formed between the transfer roller 5 and the photosensitive drum 2, a cleaning unit 6 that cleans the peripheral surface of the photosensitive drum 2 by removing residual toner from that peripheral surface, and a charge eliminator 7 that removes residual potential from the photosensitive drum 2. The charger 3, the developing device 4, the transfer roller 5, the cleaning unit 6 and the charge eliminator 7 are disposed around the photosensitive drum 2 along the rotation direction of the photosensitive drum 2 as denoted by the arrow. The image forming unit 1 has an exposure device 8 disposed above the photosensitive drum 2 and exposing the peripheral surface of the photosensitive drum 2.

The fixing unit 13 includes a heating roller 13*a*, which has an electric heating element inside as a heating source, and a pressure roller 13*b* disposed opposite the heating roller 13*a*. A nip through which the paper P passes is formed between the heating roller 13*a* and the pressure roller 13*b*.

The image forming apparatus 100 is provided therein with a paper transport path 12 along which the paper P is sequentially transported from the paper storage unit 10 to the paper discharge unit 14 through the image forming unit 1 and the fixing unit 13. Inside the image forming apparatus 100 there is also provided a paper feeder 20 that is capable of picking up the paper P from the paper storage section 10, sheet by sheet.

The image forming process is carried out in the image forming apparatus 100 as follows. The peripheral surface of the photosensitive drum 2 is uniformly charged by the charger 3. Thereafter, the exposure device 8 radiates a laser beam 9 onto the peripheral surface of the photosensitive drum 2 on the basis of image data, to expose the peripheral surface. An electrostatic latent image is formed as a result on the peripheral surface of the photosensitive drum 2. Next, the developing device 4 supplies toner onto the electrostatic latent image to develop the latter. A toner image is formed as a result on the peripheral surface of the photosensitive drum 2. Thereafter, when a paper P transported along the paper transport path 12 from the paper storage section 10 passes the nip between the photosensitive drum 2 and the transfer roller 5, the toner image is transferred to the paper P. To that end, transfer bias is applied between the photosensitive drum 2 and the transfer roller 5, to carry out smooth transfer of charged toner onto the paper P.

The paper P having the toner image formed thereon is transported to the fixing unit 13, where the paper P is subjected to a fixing process by passing through the nip between the heating roller 13*a* and the pressure roller 13*b* while being heated by the heating roller 13*a*. The fixed paper P is discharged at the paper discharge unit 14.

After transfer of the toner image from the photosensitive drum 2 onto the paper P, the residual toner on the peripheral surface of the photosensitive drum 2 is recovered by the cleaning unit 6. Residual potential on the peripheral surface of the photosensitive drum 2 is removed then by the charge eliminator 7. Thereafter, the photosensitive drum 2 is charged again by the charger 3, and the above-described image forming process is repeated.

The term "developer" will be defined first before explaining the developing device 4 according to the present embodiment. In the description of the present invention, "developer" denotes a two-component mixture consisting of "toner" and a "magnetic carrier". The term "toner" denotes microparticles prepared by binding additives such as a colorant, a charge control agent and a wax to binder resin particles, with the microparticles having surfaces covered with fluidizers or the like. The term "magnetic carrier" denotes magnetic particles such as $Fe_3O_4$ for charging the toner. The surface of the magnetic particles may be covered with a resin. The magnetic particles may be microparticles dispersed in a binder resin. The "developer" may also be a one-component system consisting of toner alone. The "toner" is a consumable that is appropriately replenished from a toner cartridge to the developing device 4. By contrast, the "magnetic carrier" is filled beforehand in a predetermined amount in the developing device 4, and is used repeatedly without being consumed. Ordinarily, therefore, the magnetic carrier is not replenished.

Figure 2:
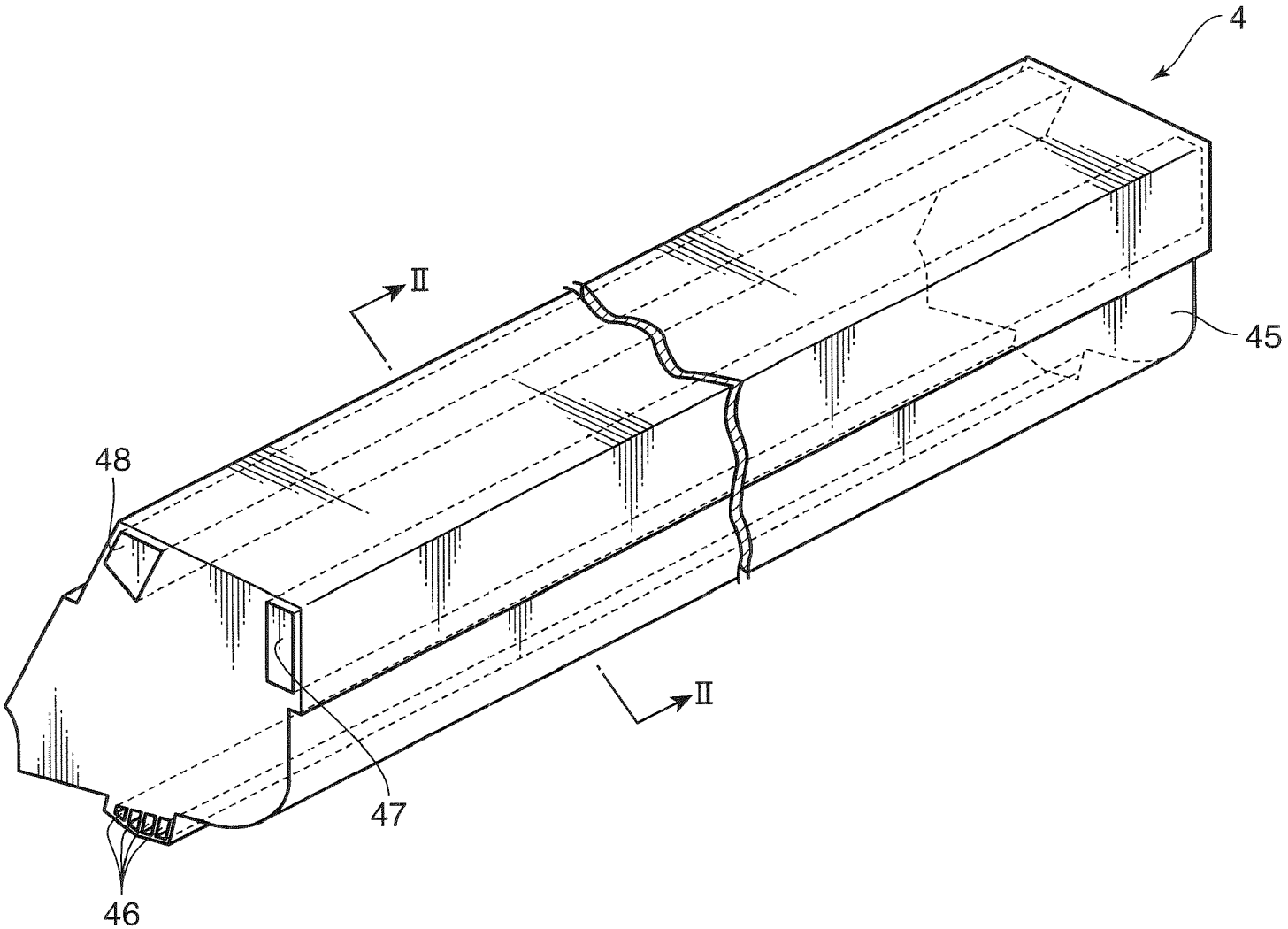
FIG. 2 is an external perspective view of the developing device.
Figure 3:
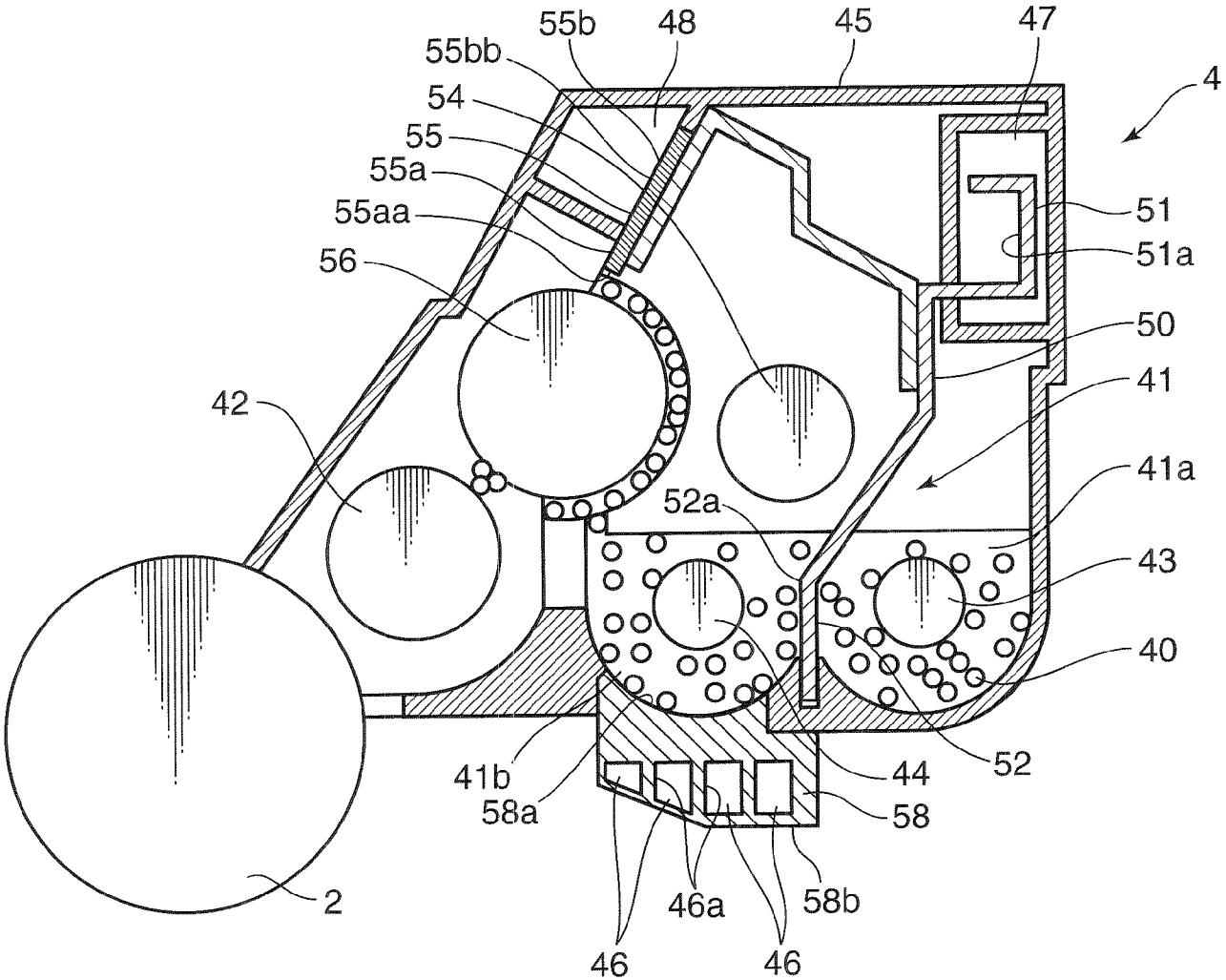
FIG. 3 is a cross-sectional view of FIG. 2 cut along line II-II.

FIG. 2 is an external perspective view of the developing device according to the present embodiment, and FIG. 3 is a cross-sectional view of FIG. 2 cut along line II-II. The developing device 4 includes a developing container (wall portion) 45 delimiting the inner space of the developing device 4 and extending in a front-rear direction of the image forming apparatus 100, and. The developing device 4 includes, in the inner space, a developer storing section 41 storing the toner-containing developer 40 and transporting the developer 40 while stirring the latter, a developing roller 42 that supplies toner (developer 40) onto the peripheral surface of the photosensitive drum 2 to form a toner image on that peripheral surface, a magnetic brush roller 56 disposed opposed to the developing roller 42, and which supplies developer 40 to the developing roller 42, an attracting magnet roller 54 arranged above the developer storing section 41 and in the vicinity of the magnetic brush roller 56 and attracting the developer 40 from the developer storing section 41 to supply the developer 40 to the magnetic brush roller 56, and a developer regulating blade (developer regulating member) 55 that regulates the amount of developer 40 supplied from the developer storing section 41 to the magnetic brush roller 56. In the present embodiment, the developing roller 42 and the magnetic brush roller 56 form a developer carrier that carries the developer 40. The developing roller 42, the magnetic brush roller 56 and the magnet roller 54 are disposed in the developing device 4 in such a manner that their axes extend along the longitudinal direction of the developing device 4.

The developing container 45 of the developing device 4 is formed integrally with a first ventilation duct 47 and a second ventilation duct 48. The first ventilation duct 47 and the second ventilation duct 48 extend in the axial directions of the developing roller 42, the magnetic brush roller 56 and the magnet roller 54. In FIG. 3, the first ventilation duct 47 is provided at the upper right corner of the developing container 45, which corresponds to a position above the developer storing section 41. The second ventilation duct 48 is provided at the upper left corner of the developing container 45, which corresponds to a position above the magnetic brush roller 56.

The developer storing section 41 is made up of two adjacent developer storing chambers 41*a*, 41*b* that extend along the longitudinal direction of the developing device 4. The developer storing chambers 41*a*, 41*b* are partitioned from each other, in the longitudinal direction of the developing device 4, by way of a partition plate 50, but communicate with each other at both ends in the longitudinal direction. Screw feeders (stirring members) 43, 44 for stirring the developer 40 by rotation are rotatably mounted respectively in the developer storing chambers 41*a*, 41*b*. The screw feeders 43, 44 are set to have opposite rotation directions, so that the developer 40 is transported between the developer storing chamber 41*a* and the developer storing chamber 41*b* while being stirred.

The developer regulating blade 55 is a plate member extending in the longitudinal direction of the developing device 4 regulating the amount of developer 40 supplied to the magnetic brush roller 56 by scraping the developer 40 that is magnetically adhered to the peripheral surface of the magnetic brush roller 56. A small gap of a predetermined size is formed between a leading end 55*a* of the developer regulating blade 55 and a peripheral surface of the magnetic brush roller 56. The developer 40 is scraped off at the above gap by the leading end 55*a* of the developer regulating blade 55 upon rotation of the magnetic brush roller 56. A developer layer of predetermined thickness is uniformly formed as a result on the peripheral surface of the magnetic brush roller 56.

In the developing device 4 having the above construction, the developer 40 is subjected to stresses between the developer regulating blade 55 and the magnetic brush roller 56 when scraped off by the leading end 55*a* of the developer regulating blade 55 at the above-described gap. Such stresses cause friction heat. Friction heat is also generated as a result of rubbing between particles of the developer 40 as the developer 40 is stirred in the developer storing section 41 by the screw feeders 43, 44. Heating of the developer 40 on account of friction heat is one factor that decreases the amount of charge in the developer 40. Friction heat causes also the temperature in the developing device 4 to rise, as a result of which the toner contained in the developer 40 melts in the developing device 4 and fuses onto the developer regulating blade 55 and so forth, thereby causing phenomena such as preventing the developer layer from forming uniformly on the magnetic brush roller 56. It becomes then difficult, as a result, to obtain a good toner image on the peripheral surface of the photosensitive drum 2. The developing device 4 according to the present embodiment, therefore, is provided with a heat-dissipating member for dissipating friction heat and suppressing rises in temperature within the developing device 4.

The developing device 4 according to the present embodiment utilizes the partition plate 50 of the developer storing section 41 as such a heat-dissipating member. Specifically, the partition plate 50 has one end (first portion) 52 arranged between the developer storing chambers 41*a*, 41*b* to partition the developer storing chambers 41*a*, 41*b*, and the other end (second portion) 51 so shaped as to extend within the first ventilation duct 47. The one end 52 is a portion in contact with the developer 40, whereas the other end 51 is a portion not in contact with the developer 40. The partition plate 50 is preferably formed of a metal such as aluminum.

The partition plate (heat-dissipating member) 50 dissipates heat as follows. The friction heat generated as a result of stirring of the developer 40 is transmitted first to the one end 52, which is in contact with the developer 40, and is transmitted next to the other end 51, which is not in contact with the developer 40. Air flows through the first ventilation duct 47, and accordingly the other end 51 extending within the first ventilation duct 47 becomes cooled by this flowing air. The friction heat is dissipated thus by way of the partition plate 50.

In the developing device 4 according to the present embodiment, the developer regulating blade 55 is also used as a heat-dissipating member. Specifically, the developer regulating blade 55 has the leading end (first portion) 55*a* that is in contact with the developer 40 carried on the peripheral surface of the magnetic brush roller 56, and a main body portion (second portion) 55*b* that excludes the leading end 55*a*. The main body portion 55*b* is arranged in such a manner that it makes up a part of the wall portion that delimits the inner space of the second ventilation duct 48. The leading end 55*a* is thus a portion in contact with the developer 40, whereas the main body portion 55*b* is a portion not in contact with the developer 40.

The developer regulating blade (heat-dissipating member) 55 dissipates heat as follows. The heat generated by the developer 40 carried on the peripheral surface of the magnetic brush roller 56 is transmitted first to the leading end 55*a* that is in contact with the developer 40, and then to the main body portion 55*b* that is not in contact with the developer 40. Air flows through the second ventilation duct 48, and accordingly the main body portion 55*b*, which makes up the part of the wall portion of the second ventilation duct 48, becomes cooled by this flowing air. The heat generated by the developer 40 on the magnetic brush roller 56 is dissipated thus via the developer regulating blade 55.

In the developing device 4 according to the present embodiment, moreover, a part of the wall portion (developing container) 45 forms a heat-dissipating member 58. Specifically, the heat-dissipating member 58 is a box-like member having a plurality of surfaces extending in the longitudinal direction of the developing device 4 along the developer storing chamber 41*b*. The heat-dissipating member 58 is shaped in such a manner that one surface 58*a*, among the plurality of surfaces, faces the developer storing chamber 41*b*, while the other surface 58*b* is exposed outside the developing device 4. The inner surface 58*a* is a portion in contact with the developer 40 in the developer storing chamber 41*b*, while the outer surface 58*b* is a portion not in contact with the developer 40. Third ventilation ducts 46 extending in the longitudinal direction of the heat-dissipating member 58 are provided inside the heat-dissipating member 58, that is, between the inner surface 58*a* and the outer surface 58*b*. The cross sectional areas of the inner spaces of the first to third ventilation ducts 47, 48 and 46 are set arbitrarily.

The heat-dissipating member 58 dissipates heat as follows. Specifically, the friction heat generated as a result of stirring of the developer 40 is transmitted first from the inner surface 58*a*, which is in contact with the developer 40, to the inner side of the heat-dissipating member 58. The heat is then dissipated by the air flowing through the third ventilation ducts 46 provided in the heat-dissipating member 58. The friction heat is led also from the inner surface 58*a* to the outer surface 58*b* that is not in contact with the developer 40, and is dissipated out of the developing device 4 through the outer surface 58*b*. This way, friction heat is dissipated by the heat-dissipating member 58.

Thus, the developing device 4 according to the present embodiment suppresses temperature rises in the developing device 4 by dissipating the friction heat of the developer 40 by way of the partition plate 50, the developer regulating blade 55 and the heat-dissipating member 58, as described above. In the present embodiment, moreover, the heat-dissipation ability of the partition plate 50, the developer regulating blade 55 and the heat-dissipating member 58 are ensured by setting the arithmetic surface roughness of the partition plate 50, the developer regulating blade 55 and the heat-dissipating member 58.

Specifically, a surface 52*a* of the one end 52 of the partition plate 50, a surface 55*aa* of the leading end 55*a* of the developer regulating blade 55 and the inner surface 58*a* of the heat-dissipating member 58 are set to have an arithmetic surface roughness Ra1 equal to or less than ⅓ of the volume average particle size of particles of the toner contained in the developer 40. Setting such an arithmetic surface roughness Ra1 makes it unlikely for the developer (toner) 40 to adhere to the surface 52*a* of the one end 52 of the partition plate 50, the surface 55*aa* of the leading end 55*a* of the developer regulating blade 55 and the inner surface 58*a* of the heat-dissipating member 58. This prevents the developer 40 from covering the surfaces 52*a*, 55*aa* and the inner surface 58*a*, thereby suppressing formation of a developer layer over the surfaces 52*a*, 55*aa* and the inner surface 58*a*. Thermal conductivity of the surfaces 52*a*, 55*aa* and the inner surface 58*a* is ensured as a result, which in turn ensures the heat dissipation ability of the partition plate 50, the developer regulating blade 55 and the heat-dissipating member 58.

In the present embodiment, moreover, a surface 51*a* of the other end 51 of the partition plate 50, a surface 55*bb* of the main body portion 55*b* of the developer regulating blade 55, the outer surface 58*b* of the heat-dissipating member 58 and inner surfaces 46*a* of the third ventilation ducts 46 are set to have an arithmetic surface roughness Ra2 equal to or greater than the arithmetic surface roughness Ra1. Setting such an arithmetic surface roughness Ra2 causes the surface areas of the surface 51*a*, the surface 55*bb*, the outer surface 58*b* and the inner surfaces 46*a* to be equal to or greater than the surface areas of the surface 52*a*, the surface 55*aa* and the inner surface 58*a*, respectively, which enhances the heat dissipation ability of the surface 51*a*, the surface 55*bb*, the outer surface 58*b* and the inner surfaces 46*a*. As a result, this allows dissipating to a greater extent the heat transmitted through the surface 52*a* of the one end 52 of the partition plate 50, the surface 55*aa* of the leading end 55*a* of the developer regulating blade 55, and the inner surface 58*a* of the heat-dissipating member 58.

The rise in temperature in the developer storing section 41 of the developing device 4 will be explained next based on Examples 1 to 4 according to the present embodiment and Comparative example 1, while referring to Tables 1 and 2. Table 1 summarizes the toner volume average particle size and the arithmetic surface roughness Ra1 and Ra2 set in Examples 1 to 4 and Comparative example 1. In Examples 1 to 4 and Comparative example 1, the arithmetic surface roughness Ra1 was set for the surface 52*a* of the one end 52 of the partition plate 50 and the inner surface 58*a* of the heat-dissipating member 58, and the arithmetic surface roughness Ra2 was set for the surface 51*a* of the other end 51 of the partition plate 50 and the inner surfaces 46*a* of the third ventilation ducts 46.

Specifically, in Examples 1 to 4, the arithmetic surface roughness Ra1 was set to be less than ⅓ of the volume average particle size of the toner, while in Comparative example 1, the arithmetic surface roughness Ra1 was set to be greater than ⅓ of the volume average particle size of the toner. The arithmetic surface roughness Ra1 was measured using a SURFCOM 1500DX, by Tokyo Seimitsu (JIS B0601-1994). The measurement conditions, in accordance with the JIS-94 standard, involved measuring roughness for measurement categories, with a measurement length of 4.0 mm, a cutoff wavelength of 0.8 mm and a measurement speed of 0.3 mm/s. The toner volume average particle size of the toner was measured using a Coulter Multisizer III (by Beckman Coulter), with an aperture diameter of 100 μm. The magnetic carrier used in the developer 40 had a weight average particle size of 40 μm and a saturation magnetization of 65 emu/g. Saturation magnetization was measured using a VSM-P7, by TOEI, in a magnetic field of 79.6 kA/m (1 kOe).

TABLE 1

| | Surface Ra1 (μm) in contact | Surface Ra2 (μm) not in contact | Toner volume average particle size (μm) |
|---|---|---|---|
| Example 1 | 2.0 | 2.0 | 6.5 |
| Example 2 | 2.0 | 3.0 | 6.5 |
| Example 3 | 1.0 | 2.0 | 6.5 |
| Example 4 | 0.1 | 2.0 | 5.8 |
| Comparative example 1 | 3.0 | 3.0 | 6.5 |

Figure 4:
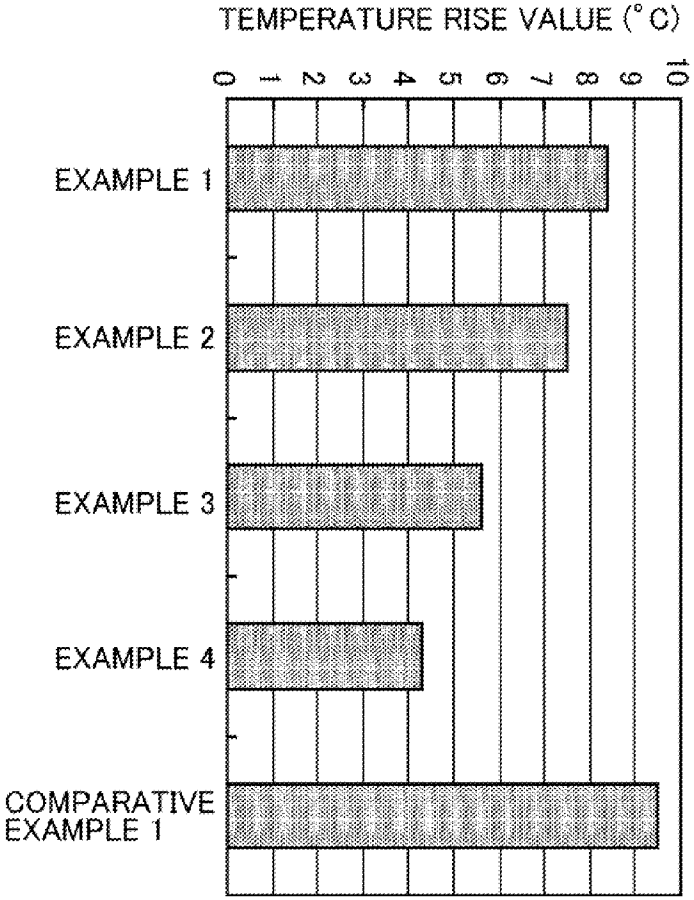
FIG. 4 is a table that illustrates the rise in temperature in the developer storing section upon continuous printing of 1000 sheets.

FIG. 4 illustrates the rise in temperature in the developer storing section 41 upon continuous printing (print density 5%) of 1000 sheets in an external environment at a temperature of 28° C. and 80% humidity. The ordinate axis represents the temperature rise value denoting the increment in temperature from 28° C., and the abscissa axis represents Examples 1 to 4 and Comparative example 1. The temperature of the developer storing section 41 was measured using instruments NR-1000, NR-250 and the like by KEYENCE.

FIG. 4 shows, the rise in temperature was more suppressed in Examples 1 to 4 than in Comparative example 1. Among Examples 1 to 4, the temperature rise value was smallest in Example 4 and largest in Example 1. In Example 2, the rise in temperature was more suppressed than in Example 1 since a greater arithmetic surface roughness Ra2 of 3.0 μm was set. In Example 3 where the arithmetic surface roughness Ra1 was set to be smaller than ⅙ of the volume average particle size of the toner, the rise in temperature was more suppressed in Example 3 than in Examples 1 and 2. In Example 4 where the arithmetic surface roughness Ra1 was set to be extremely small compared with the arithmetic surface roughness Ra1 of the Examples 1 to 3, the rise in temperature was more suppressed in Example 4 than in Examples 1 to 3.

It was observed in Comparative example 1 that toner fused on the surface 52*a* of the one end 52 of the partition plate 50 and on the inner surface 58*a* of the heat-dissipating member 58. In Examples 1 to 4, however, no noticeable toner fusion was observed on the surface 52*a* and the inner surface 58*a*. The toner used had a glass transition temperature (Tg) of 52° C. In Comparative example 1, the temperature rise value exceeded 9° C., and the temperature in the developer storing section 41 exceeded 28° C.+9° C.=37° C. Thus, part of the toner is believed to have fused on the surface 52*a* and the inner face 58*a*. In Examples 1 to 4, by contrast, the temperature rise value was kept lower than that in Comparative example 1. Thus, no toner is believed to have fused on the surface 52*a* and the inner surface 58*a*. The results in Examples 1 to 4 and Comparative example 1 indicate that toner fusion occurs when the temperature exceeds Tg−15° C.=37° C. Examples 1 to 4 and Comparative example 1 were conducted under environment conditions that involved an external temperature of 28° C. and 80% humidity. The temperature at which toner fusion occurs varies depending on the binder resin of the toner, the characteristics of the release agent (wax) as well as on the thermal characteristics of the toner, which are governed by toner manufacturing conditions.

Figure 5:
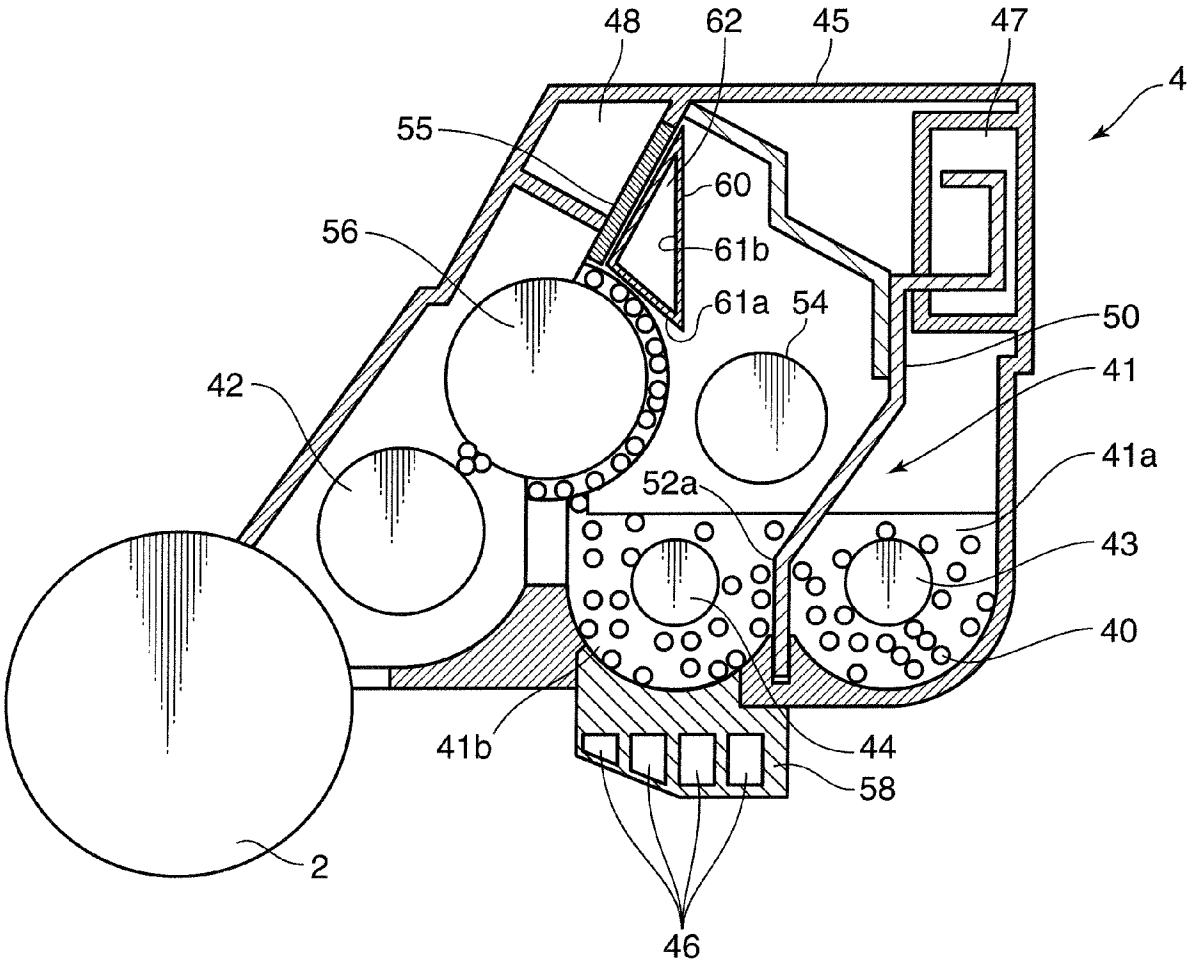
FIG. 5 is a cross-sectional view illustrating the configuration of the developing device having an additional heat-dissipating member.

FIG. 5 is a cross-sectional view illustrating the construction of the developing device 4 of FIG. 3 having an additional heat-dissipating member 60. The heat-dissipating member 60 is used for dissipating, together with the developer regulating blade 55, the heat from the developer 40 carried by the magnetic brush roller 56. Specifically, the heat-dissipating member 60 is a ventilation duct, having for instance a triangular cross section, that is disposed extending in the longitudinal direction of the developing device 4 in the vicinity of the magnetic brush roller 56. The heat-dissipating member 60 has an outer surface 61*a*, extending along the peripheral surface of the magnetic brush roller 56 and arranged in contact with the developer 40 on that peripheral surface, and an inner surface 61*b* that is arranged in contact with air flowing through the inner space of the heat-dissipating member 60. The outer surface 61*a* increases the contact area between the heat-dissipating member 60 and the developer 40. The arithmetic surface roughness Ra1 of the outer surface 61*a* of the heat-dissipating member 60 is set to be equal to or less than ⅓ of the volume average particle size of the toner, while the arithmetic surface roughness Ra2 of the inner surface 61*b* is set to be equal to or greater than the arithmetic surface roughness Ra1.

The heat-dissipating member 60 dissipates heat from the developer 40 as follows. Specifically, the friction heat generated by the developer 40 carried on the peripheral surface of the magnetic brush roller 56 is first transmitted from the outer surface 61*a*, which is in contact with the developer 40 on the peripheral surface of the magnetic brush roller 56, to the inner surface 61*b* of the heat-dissipating member 60, which is then cooled by air flowing through the inner space of the heat-dissipating member 60. The outer surface 61*a* of the heat-dissipating member 60 has a large contact area with the developer 40, and hence the heat-dissipating member 60 achieves better dissipation of heat from the developer 40 than the developer regulating blade 55, which exhibits a relatively small contact area with the developer 40. The heat-dissipating member 60 may serve as a support plate that supports the developer regulating blade 55, or may be integrally formed with the developer regulating blade 55.

In the developing device 4 described above, the arithmetic surface roughness Ra1 was set for the surface 52*a* of the one end 52 of the partition plate 50, the surface 55*aa* of the leading end 55*a* of the developer regulating blade 55, the inner surface 58*a* of the heat-dissipating member 58 and the outer surface 61*a* of the heat-dissipating member 60, while the arithmetic surface roughness Ra2 was set for the surface 51*a* of the other end 51 of the partition plate 50, the surface 55*bb* of the main body portion 55*b* of the developer regulating blade 55, the outer surface 58*b* of the heat-dissipating member 58 and the inner surface 61*b* of the heat-dissipating member 60. The surfaces for which the arithmetic surface roughness Ra1 and Ra2 are set, however, are not limited to the above surfaces. The arithmetic surface roughness Ra1 may be set for any surface in the developing device 4 that is in contact with the developer 40, and the arithmetic surface roughness Ra2 may be set for any surface in the developing device 4 that is not in contact with the developer 40.

The developing device according to the present embodiment as explained has the constituent features below.

The developing device includes a developer storing section storing a developer, a stirring member disposed in the developer storing section and transporting the developer while stirring the developer, a developer carrier receiving the developer from the developer storing section and carrying the developer, a developer regulating member regulating the amount of the developer received by the developer carrier from the developer storing section, and a heat-dissipating member disposed at a position in contact with the developer and capable of dissipating heat of the developer. The heat-dissipating member has a surface in contact with the developer. The contact surface of the heat-dissipating member has an arithmetic surface roughness Ra1 that is set to be equal to or less than ⅓ of the volume average particle size of toner particles contained in the developer.

In the developing device having the above construction, since the contact surface of the heat-dissipating member in contact with the developer is set to have the arithmetic surface roughness Ra1 equal to or less than ⅓ of the volume average particle size of toner particles contained in the developer, the developer is unlikely to become adhered to the contact surface. The heat dissipation ability of the heat-dissipating member can thereby be ensured in terms of dissipating the friction heat generated, for instance, when the developer is stirred. As a result, rise in temperature is suppressed in the developing device.

In the developing device having the above construction, the heat-dissipating member has a surface that is not in contact with the developer and the non-contact surface has an arithmetic surface roughness Ra2 that is set to be equal to or greater than the arithmetic surface roughness Ra1. In such a construction, the surface of the heat-dissipating member that is not in contact with the developer becomes to have a large area, which improves the heat dissipation ability of the non-contact surface.

In the developing device having the above configuration, preferably, the heat-dissipating member is a plate member having a first portion extending in the developer storing section and a second portion, different from the first portion, extending outside the developer storing section. The first portion has a surface set to have the arithmetic surface roughness Ra1 and the second portion has a surface set to have the arithmetic surface roughness Ra2.

In the developing device having the above configuration, preferably, the heat-dissipating member is constituted by the developer regulating member and the developer regulating member is a plate member having a first portion in contact with the developer on the developer carrier and a second portion, different from the first portion, positioned spaced apart from the developer carrier. The first portion has a surface set to have the arithmetic surface roughness Ra1 and the second portion has a surface set to have the arithmetic surface roughness Ra2.

Preferably, the developing device further includes a ventilation duct through which a cooling air flows, and the second portion is disposed in the ventilation duct.

In the developing device having the above configuration, preferably, the developing device further includes a wall portion delimiting a space that forms the developer storing section. The heat-dissipating member forms at least a part of the wall portion and has one surface facing the inside of the developer storing section and the other surface facing the outside of the developer storing section. The one surface is set to have the arithmetic surface roughness Ra1 and the other surface is set to have the arithmetic surface roughness Ra2.

In the developing device having the above configuration, preferably, the heat-dissipating member has a ventilation duct interposed between the one surface and the other surface.

As described above, the heat-dissipating member is preferably constituted by a plate member provided in the developer storing section, the developer regulating member that regulates the developer amount, or a wall portion that forms the developer storing section, or a combination thereof. When the heat-dissipating member is the plate member or the wall portion, the heat-dissipating member can dissipate the friction heat that is generated upon stirring of the developer in the developer storing section. When the heat-dissipating member is the developer regulating member, the heat-dissipating member can dissipate the heat generated by the developer on the developer carrier. Moreover, the heat-dissipating member is constructed in such a manner that surfaces having the arithmetic surface roughness Ra2 are cooled by the ventilation duct. This enhances heat dissipation by the heat-dissipating member.

In the developing device having the above configuration, preferably, the heat-dissipating member is a ventilation duct formed integrally with the developer regulating member or disposed in the vicinity of the developer regulating member. The ventilation duct has an outer surface facing the developer carrier and an inner surface which an air flowing inside the ventilation duct contacts. The outer surface extends along a surface of the developer carrier so as to be held in contact with the developer on the surface of the developer carrier. The outer surface is set to have the arithmetic surface roughness Ra1 and the inner surface is set to have the arithmetic surface roughness Ra2.

In the above configuration, dissipation of heat from the developer on the developer carrier can be enhanced by the ventilation duct, together with the developer regulating member as the heat-dissipating member.

Preferably, the position of the ventilation duct is set in such a manner that the outer surface comes into contact with the developer on the developer carrier before the developer regulating member regulates the developer on the developer carrier.

In the above configuration, the developer on the developer carrier is cooled by the ventilation duct before coming into contact with the developer regulating member. This suppresses adhesion of the developer onto the developer regulating member, and hence suppresses loss of performance in the developer regulating member caused by the developer adhesion.

This application is based on Japanese patent application serial No. 2008-112891, filed in Japan Patent Office on Apr. 23, 2008, the contents of which is hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device comprising:

a developer storing section storing a developer;

a stirring member disposed in the developer storing section and transporting the developer while stirring the developer;

a developer carrier receiving the developer from the developer storing section and carrying the developer;

a developer regulating member regulating the amount of the developer received by the developer carrier from the developer storing section; and a heat-dissipating member disposed at a position in contact with the developer and capable of dissipating heat of the developer, the heat-dissipating member having a contact surface in contact with the developer, the contact surface having an arithmetic surface roughness Ra1 that is set to be equal to or less than ⅓ of the volume average particle size of toner particles contained in the developer, the heat-dissipating member having a non-contact surface that is not in contact with the developer, the non-contact surface having an arithmetic surface roughness Ra2 that is set to be equal to or greater than the arithmetic surface roughness Ra1, wherein the heat-dissipating member is a plate member having a first portion extending in the developer storing section and a second portion, different from the first portion, extending outside the developer storing section; and wherein the first portion has a surface set to have the arithmetic surface roughness Ra1 and the second portion has a surface set to have the arithmetic surface roughness Ra2.

2. The developing device according to claim 1, further comprising a ventilation duct through which a cooling air flows; and wherein the second portion is disposed in the ventilation duct.

3. A developing device comprising:

a wall portion delimiting a space that forms a developer storing section storing a developer;

a heat-dissipating member disposed at a position in contact with the developer and capable of dissipating heat of the developer, the heat-dissipating member having a contact surface in contact with the developer, the contact surface having an arithmetic surface roughness Ra1 that is set to be equal to or less than ⅓ of the volume average particle size of toner particles contained in the developer, the heat-dissipating member having a non-contact surface that is not in contact with the developer, the non-contact surface having an arithmetic surface roughness Ra2 that is set to be equal to or greater than the arithmetic surface roughness Ra1, the heat-dissipating member forming at least a part of the wall portion and having one surface facing inside of the developer storing section and another surface facing outside of the developer storing section; and wherein the one surface is set to have the arithmetic surface roughness Ra1 and the other surface is set to have the arithmetic surface roughness Ra2.

4. The developing device according to claim 3, wherein the heat-dissipating member has a ventilation duct interposed between the one surface and the other surface.

5. An image forming apparatus, comprising:

a photosensitive drum on which a toner image is formed;

a developing device forming the toner image on the photosensitive drum; and a fixing unit fixing the toner image to a paper on which the toner image is transferred from the photosensitive drum;

the developing device including:

a developer storing section storing a developer;

a stirring member disposed in the developer storing section and transporting the developer while stirring the developer;

a developer carrier receiving the developer from the developer storing section and carrying the developer;

a developer regulating member regulating the amount of the developer received by the developer carrier from the developer storing section; and a heat-dissipating member disposed at a position in contact with the developer and capable of dissipating heat of the developer, the heat-dissipating member having a contact surface in contact with the developer, the contact surface having an arithmetic surface roughness Ra1 that is set to be equal to or less than ⅓ of the volume average particle size of toner particles contained in the developer, the heat-dissipating member having a non-contact surface that is not in contact with the developer, the non-contact surface having an arithmetic surface roughness Ra2 that is set to be equal to or greater than the arithmetic surface roughness Ra1, wherein the heat-dissipating member is a plate member having a first portion extending in the developer storing section and a second portion, different from the first portion, extending outside the developer storing section; and wherein the first portion has a surface set to have the arithmetic surface roughness Ra1 and the second portion has a surface set to have the arithmetic surface roughness Ra2.

6. The image forming apparatus according to claim 5, further comprising a ventilation duct through which a cooling air flows; and wherein the second portion is disposed in the ventilation duct.

7. An image forming apparatus comprising:

a photosensitive drum on which a toner image is formed;

a developing device forming the toner image on the photosensitive drum; and a fixing unit fixing the toner image to a paper on which the toner image is transferred from the photosensitive drum;

the developing device including:

a wall portion delimiting a space that forms a developer storing section storing a developer;

a stirring member disposed in the developer storing section and transporting the developer while stirring the developer;

a developer carrier receiving the developer from the developer storing section and carrying the developer;

a developer regulating member regulating the amount of the developer received by the developer carrier from the developer storing section; and a heat-dissipating member disposed at a position in contact with the developer and capable of dissipating heat of the developer, the heat-dissipating member having a contact surface in contact with the developer, the contact surface having an arithmetic surface roughness Ra1 that is set to be equal to or less than ⅓ of the volume average particle size of toner particles contained in the developer, the heat-dissipating member further having a non-contact surface that is not in contact with the developer, the non-contact surface having an arithmetic surface roughness Ra2 that is set to be equal to or greater than the arithmetic surface roughness Ra1, wherein the heat-dissipating member forms at least a part of the wall portion and has one surface facing the inside of the developer storing section and the other surface facing the outside of the developer storing section; and wherein the one surface is set to have the arithmetic surface roughness Ra1 and the other surface is set to have the arithmetic surface roughness Ra2.

8. The image forming apparatus according to claim 7, wherein the heat-dissipating member has a ventilation duct interposed between the one surface and the other surface.

* * * * *